US007172090B2

(12) United States Patent
Jackson

(10) Patent No.: US 7,172,090 B2
(45) Date of Patent: Feb. 6, 2007

(54) CONTAINER ACCESSORY FOR PROTECTING A CONTAINER RIM AND BRUSH

(76) Inventor: Vernon V. Jackson, 341 N. Commonwealth Ave., Elgin, IL (US) 60123

( * ) Notice: Subject to any disclaimer, the term of this patent is extended or adjusted under 35 U.S.C. 154(b) by 425 days.

(21) Appl. No.: 10/744,392

(22) Filed: Dec. 23, 2003

(65) Prior Publication Data

US 2005/0133517 A1 Jun. 23, 2005

(51) Int. Cl.
*B65D 25/00* (2006.01)
*B65D 1/40* (2006.01)

(52) U.S. Cl. ..... 220/695; 220/736; 220/733; 220/731

(58) Field of Classification Search ..... 220/695–702, 220/736, 731, 733
See application file for complete search history.

(56) References Cited

U.S. PATENT DOCUMENTS

| | | | | | |
|---|---|---|---|---|---|
| 413,526 | A | | 10/1889 | Light | |
| 1,283,533 | A | | 11/1918 | Leighton | |
| 1,635,072 | A | | 7/1927 | DeLuna | |
| 2,151,895 | A | * | 3/1939 | Wigo | 220/697 |
| 2,268,241 | A | | 12/1941 | Brueckel | |
| 2,591,482 | A | | 4/1952 | Weltlich | |
| 2,611,508 | A | | 9/1952 | Brown | |
| 2,873,052 | A | * | 2/1959 | Atherton | 222/570 |
| 2,903,154 | A | * | 9/1959 | Hendershot | 220/697 |
| 2,945,611 | A | | 7/1960 | Weiffenbach | |
| 3,168,962 | A | * | 2/1965 | Rawlins et al. | 220/697 |
| 3,239,113 | A | * | 3/1966 | Knize | 222/569 |
| 3,356,266 | A | * | 12/1967 | Pinter, Jr. | 222/192 |
| 3,395,828 | A | * | 8/1968 | Schnabel | 220/697 |
| 3,407,429 | A | | 10/1968 | DiNardo | |
| 3,688,943 | A | | 9/1972 | Brown | |
| 3,899,107 | A | * | 8/1975 | Gaal | 222/570 |
| 4,125,210 | A | | 11/1978 | Embree | |
| 4,203,537 | A | * | 5/1980 | McAlister | 222/570 |
| 4,312,459 | A | * | 1/1982 | Leach | 220/256.1 |
| 4,316,560 | A | * | 2/1982 | Carter | 222/567 |
| 4,352,438 | A | * | 10/1982 | Carino | 220/733 |
| 4,369,890 | A | | 1/1983 | Bennett | |
| 4,436,217 | A | | 3/1984 | Ritter | |
| 4,583,666 | A | | 4/1986 | Buck | |
| 4,728,003 | A | | 3/1988 | Davey | |
| 4,979,237 | A | | 12/1990 | Hazar et al. | |

(Continued)

*Primary Examiner*—Jes F. Pascua
*Assistant Examiner*—Shawn M Braden
(74) *Attorney, Agent, or Firm*—Meroni & Meroni, P.C.; Charles F. Meroni, Jr.; Christopher J. Scott

(57) ABSTRACT

The present invention provides a paint container accessory, which container accessory enables the user to simultaneously protect the annular groove or rim of a conventional paint container as well as the paint brush or implement used in connection therewith. The container accessory comprises a uniquely configured protective rim cover in combination with a painting implement receptacle. The rim cover retains the painting implement receptacle in adjacency to the paint container. The paint brush receptacle used in combination with the uniquely configured rim cover is formed from a material impervious to air and may be enclosed so that when painting implements are placed into the painting implement receptacle, the evaporative processes associated with drying paint process may be slowed. The rim cover is outfitted with structure to prevent horizontal or vertical shift when the rim cover is installed on the rim of a paint container.

20 Claims, 3 Drawing Sheets

U.S. PATENT DOCUMENTS

| | | | | | |
|---|---|---|---|---|---|
| 5,012,960 | A | | 5/1991 | Arnold | |
| 5,123,565 | A | * | 6/1992 | Majewski | 220/701 |
| 5,297,695 | A | * | 3/1994 | Provence | 220/697 |
| 5,472,111 | A | * | 12/1995 | Renfrew | 220/570 |
| 5,549,216 | A | * | 8/1996 | Scholl | 220/695 |
| 5,641,089 | A | * | 6/1997 | Palank | 220/733 |
| 5,752,619 | A | * | 5/1998 | Fulton | 220/701 |
| 5,893,489 | A | * | 4/1999 | Giarrante | 222/482 |
| 6,056,146 | A | * | 5/2000 | Varakian et al. | 220/370 |
| 6,253,951 | B1 | * | 7/2001 | Pruckler | 220/733 |
| 6,446,829 | B1 | * | 9/2002 | Malvasio et al. | 220/697 |
| 6,539,991 | B1 | * | 4/2003 | Ackerman | 141/331 |
| 6,929,225 | B1 | * | 8/2005 | Kent | 248/213.2 |
| 2002/0096527 | A1 | * | 7/2002 | Arenas et al. | 220/570 |
| 2003/0121925 | A1 | | 7/2003 | Mowe | |

* cited by examiner

CONTAINER ACCESSORY FOR PROTECTING A CONTAINER RIM AND BRUSH

BACKGROUND OF THE INVENTION

1. Field of the Invention

The present invention generally relates to a paint container attachment or adjunct. More particularly, the present invention relates to a protective assemblage for use in combination with a conventional paint container. The protective assemblage or container attachment includes a tool or brush holder, which tool or brush holder functions to prevent or restrict evaporative processes associated with drying of excess paint retained by the painting implement or brush.

2. Description of the Prior Art

Paint essentially comprises two parts, namely, a liquid part and a solid part. The molecules (or atoms or ions) of a liquid, like those of a solid (and unlike those of a gas), are quite close together; however, while molecules in a solid are held in fixed positions by intermolecular forces, molecules in a liquid have too much thermal energy to be bound by these forces and move about freely within the liquid, although they cannot escape the liquid easily. Although the molecules of a liquid have greater cohesion than those of a gas, it is not sufficient to prevent some of those at the free surface of the liquid from bounding off via the process of evaporation.

Evaporation is the change of a liquid into vapor at any temperature below its boiling point. For example, water, when placed in a shallow open container exposed to air, gradually disappears, evaporating at a rate that depends on the amount of surface exposed, the humidity of the air, and the temperature. Evaporation occurs because among the molecules near the surface of the liquid there are always some with enough heat energy to overcome the cohesion of their neighbors and escape. At higher temperatures the number of energetic molecules is greater, and evaporation is more rapid. Evaporation is also increased by increasing the surface area of the liquid or by increasing the air circulation, thus carrying away the energetic molecules leaving the liquid before they can be slowed enough by collisions with air molecules to be reabsorbed into the liquid. If the air is humid some water molecules from the air will pass back into the liquid, thus reducing the rate of evaporation. An increase in atmospheric pressure also reduces evaporation. The process of evaporation is always accompanied by a cooling effect. The reason for this is that only the most energetic molecules of liquid are lost by evaporation, so that the average energy of the remaining molecules decreases; the surface temperature, which is a measure of this average energy, decreases also.

The liquid portion of paint, commonly referred to as the "carrier", provides a means for transferring the solids (pigments and binders) from the paint container onto the surface that is to be painted. For most oil-based and alkyd paints, the liquid component is paint thinner, which is a combustible solvent made primarily of mineral spirits, a petroleum distillate of aliphatic hydrocarbons. For shellac-based primers and varnishes, the liquid is denatured alcohol. For clear and pigmented lacquers, the liquid is usually lacquer thinner or another solvent that is "stronger" and more flammable than paint thinner. For latex paints, the liquid is primarily water.

Thus when paint dries, some of the liquid, evaporates. As the liquid portion evaporates, the liquid molecules become airborne leading to the distinctive odor one often detects when entering a freshly painted room. As the paint dries, the attractive forces of the remaining molecules increase to form a solid. In more modern paint formulations, there is an additional process. As the paint dries, the remaining molecules become so close that the molecules join to form a molecule that is twice the size of the original. The combining of molecules continues until all are connected to essentially form one large molecule.

The pigments and the binders are what are left on the surface when the paint dries and the liquid portion evaporates. Together, they may be referred to as the solids portion of paint. When a paint or coating is applied at a given thickness, and it then dries, the proportion of solids and liquid determines how thick the dried paint film will be. Thus, higher solids content can provide a thicker dry paint film, which results in better coverage and durability. For this reason, it is recommended that paints not be thinned unless necessary (such as for application by spraying), since thinning reduces the solids content of the paint per unit of volume. The solids content of paint may be in its specification sheet, often expressed in terms of weight or volume. The weight solids of paint is usually higher than its volume solids. Volume solids are a better indicator of performance than are weight solids. Latex paints generally range from 25% to about 40% volume solids, depending on type and quality. Alkyd and oil-based paints can exceed 50% volume solids.

Paint containers have customarily been provided with an annular groove spaced somewhat inwardly from the wall of the container at its open end or rim. This groove is adapted to receive a flange on the cover or lid, the cover flange being pried out from frictional engagement with the walls of the groove when the paint container is opened. (See U.S. Pat. No. 2,591,482). As noted in U.S. Pat. No. 2,591,482, during the painting operation, the user will often wipe the paint brush or painting implement on the rim of the paint container after dipping the same into the paint container in an effort to remove excess paint. A significant quantity of excess paint often collects in the annular groove, which acts as a sort of paint reservoir. If left in the groove, the paint will dry according to the described processes, thereby not only wasting paint but rendering it difficult to reseat the cover flange in the groove. Similarly, the paint brush or painting implement used, if left exposed to the air, will dry out, thus rendering the paint brush ineffective unless provided with additional brush maintenance, such as placing the brush into a paint thinning solvent.

Painters, for various reasons, are often desirous of foregoing proper care or maintenance of paint container and painting implements and thus a need has arisen for means to protect the annular groove or rim of paint containers as well as the painting implements that are used in connection therewith. In this regard, it is noted that there are a variety of inventive devices taught by the prior art that provide means for protecting the annular groove of a paint container as well as a number of devices for holding a painting implement in adjacency to the paint container. Some of the more pertinent prior art relating to paint container rim protective devices and the like is described hereinafter.

U.S. Pat. No. 2,268,241 ('241 patent), which issued to Brueckel, discloses a Can Chime Cover. The '241 patent teaches a can chime cover (not made of a synthetic plastic) that provides a device for covering and protecting the sealing groove of a can which may contain paint or other materials. It is thus contemplated that the can chime cover operates in combination with a container comprising opening in one end surrounded by a sealing groove adapted frictionally to engage a cover flange, of a protective ring extending around the end of the container, said ring being of channel section and comprising an outer flange fitting over the outer surface of the container and inner flange extending into said opening, the portion of the ring between the flanges sloping downwardly toward the inner flange, said inner flange providing a wiping surface for a brush dipped in the contents of the can, the intermediate portion of said ring serving to prevent deposit of said contents in said sealing groove.

U.S. Pat. No. 2,611,508 ('508 patent), which issued to Brown, discloses a Guard for Groove Top Containers. The '508 patent claims a container comprising in its top an opening and a surrounding annular groove to receive a lid-flange, and means for filling the annular groove and exposing the adjacent inner and outer margins of the container top and its opening, comprising a flange-substituting annular narrow flat sheet filler fitted in the groove and frictionally engaging against the inner wall of the groove by its inner periphery and frictionally engaging against the outer wall of the groove by its outer periphery, and a lifting tab on said annular filler.

U.S. Pat. No. 3,407,429 ('429 patent), which issued to Di Nardo, discloses a Paint Can Apron and Brush Holder. The '429 patent teaches a paint drip apron detachably secured by barb-like members to the bottom of a can of paint and a brush holder comprising means mounting it on the can of paint at the top so that the drip from a brush in the brush holder will drip onto the apron.

U.S. Pat. No. 3,688,943 ('943 patent), which issued to Brown, discloses a Rim Protector and Painting Implement Container for Paint Cans. The '943 patent teaches a plastic ring comprising at its outer edge a flange or other clamping means to fit over and to attach securely to the circular rim of an open paint can. The clamping means serves to hold the ring securely in place by tightly engaging the exterior side wall of the paint can at the rim, and yet allows the ring to be readily removed from the can. The open center of the ring is of sufficient dimensions to permit the dipping of a brush into the paint in the can while the ring is attached. At least a portion of the inner edge of the ring defining this open center provides a scraping edge for removing excess paint from the brush. A small container for holding the brush in an upright is retained against the exterior side wall of the can by an arm secured to the clamping means. A screen is mounted in and at least slightly above the bottom wall of the container to act as a resting surface for the tip of the brush while in use, to allow excess paint to drip free thereof.

U.S. Pat. No. 4,352,438 ('438 patent), which issued to Carino, discloses a Protective Shield of Open Container. The '438 patent teaches a protective device for temporarily shielding the upper surfaces of an open liquid container, such as a paint can or the like, to prevent the contained liquid from accumulating upon the upper surfaces thereof. The device involves an endless loop made of a deformable metal foil that is passed partially over the top of the container so that the top section of the loop extends upwardly above the upper rim of the container. The top section is folded inwardly over the rim of the container and is pressed tightly thereagainst to form a tight seal. The outer portion of the folded section is then passed downwardly into the container opening to form a circular wall depending from the lip of the rim which serves to prevent contained liquid from spilling over the lip of the rim.

U.S. Pat. No. 4,436,217 ('217 patent), which issued to Ritter, discloses a Paint Brush Support. The '217 patent teaches a paint brush support that is attached to the outer portion of a paint container comprising a brush container in the form of an open top vessel comprising an opening formed at an upper edge of an inside wall. The opening snugly engages a bale support button of the paint container to support the brush container to the paint container. An elastic ring snugly engageable with the paint container holds the brush container in abutment to the paint container.

U.S. Pat. No. 4,583,666 ('666 patent), which issued to Buck, discloses a Container Attachment. The '666 patent teaches an annular rim guard comprising an outer wall connected to an annular sloping ring for fitted placement on an open paint container. The annular ring covers a lid receiving groove in a container rim. Integral securing members with C-shaped openings removably secure the rim guard to bail bearings of the container. Sealing flanges are integrally fixed to the bottom of the annular ring portion to provide a sealing contact surface. A paintbrush holder receptacle with a brush receiving opening and a drain opening is fixed to the rim guard for maintaining a paint brush in a substantially upright position. The drain opening at the bottom of the brush holder is positioned over the can openings to allow excess paint from a paint brush in the holder to drain into the container interior.

U.S. Pat. No. 5,012,960 ('960 patent), which issued to Arnold, discloses a Groove Protector and Spout. The '960 patent teaches a paint can top lid groove protector and spout comprising a ring formed with a top surface and an inside wall and outside wall. The ring is engageable in a covering relationship to a paint can rim groove, formerly occupied by a can lid. The contents of the can remain exposed. The spout comprises a pair of pour guards defining an orifice for pouring. The pour guards have raised lip portions extending to the outer edge of the ring.

From a review of these patents and other prior art generally known to exist, it will be seen that the prior art does not teach a paint container accessory which functions to protect both (1) the annular groove or rim of a conventional paint container from collecting paint, which groove or rim may otherwise serve as a reservoir for allowing the collected paint to dry; and (2) the painting implement used for transferring paint from the paint container to the surface to be coated, which implement may otherwise dry out and become ineffective without proper maintenance. While the '943 patent, the '217 patent, and the '666 patent do teach small brush receptacles for holding paint brushes in an upright position in adjacency to the exterior side wall of a paint container, none teach an encloseable brush receptacle for preventing evaporation of volatile liquids from the paint held or retained by the painting implement when not in use.

It will thus be seen that the prior art does not teach a paint container accessory for protecting a paint container rim and a paint brush from becoming ineffective from retained dry paint. Of the paint container rim guards and brush holders that have been developed, none provide a combination rim guard and brush holder, which rim guard functions to direct paint away from the paint container rim and which brush holder or receptacle functions to retard evaporation of the liquid component of paint. The prior art thus perceives a need for a container accessory or container assembly for use in combination with a paint container that functions to direct paint away from the paint container rim and further serves to retard evaporation of the liquid components from excess paint retained by a paint brush or other painting implement.

SUMMARY OF THE INVENTION

Accordingly, it is an object of the present invention to provide a low cost, maintenance-efficient paint container accessory, which container accessory enables the user to simultaneously protect the annular groove or rim of a conventional paint container as well as the paint brush or implement used in connection therewith. In this regard, it is an object of the present invention to provide a container accessory for use in combination with a paint container, which container accessory embodies improvements over the state of the art. Further, it is an object of the present invention to provide a container accessory constructed from low cost materials, formed into readily disposable single use items. More specifically, it is an object of the present invention to provide a paint container accessory wherein the container accessory comprises a uniquely configured rim cover for seated placement upon the rim of a paint container, the exposed or paint-deflecting surface of which deflects paint away from the paint container rim. Further, it is an object of the present invention to provide a container accessory further comprising a paint brush receptacle, which receptacle functions to not only retain a user's paint brush in adjacency to the paint container, but also functions to retard the evaporation of liquid components from excess paint held by the paint brush. In this last regard, it is an object of the present invention to provide a paint brush receptacle, the mouth of which comprises closure means, the closure means for selectively enclosing the paint brush receptacle for retarding the evaporative processes.

To achieve these and other readily apparent objectives, the present invention provides a uniquely configured protective rim cover for use in combination with a conventional paint container, which rim cover comprises means for retaining a paint brush receptacle in adjacency to the conventional paint container. The paint brush receptacle used in combination with the uniquely configured rim cover is formed from a material impervious to air and may comprise closure means at the mouth so that when painting implements are placed into the paint brush receptacle the paint drying process may be slowed.

More particularly, the present invention provides a container accessory for use in combination with a conventional paint container, which paint container typically comprises an interior container surface, an exterior container surface, and an annular groove or rim intermediate the interior container surface and the exterior container surface. The interior container surface typically retains a paint volume and the rim typically has an outer rim perimeter distinguishable from an inner rim perimeter, the inner rim perimeter defining a paint access aperture. The container accessory essentially comprises a protective rim cover, which rim cover comprises a container-engaging surface, a paint-deflecting surface, a container access aperture extending from the paint-deflecting surface to the container-engaging surface, a substantially horizontal paint shield region adjacent the container access aperture, and at least three substantially vertical flap regions. Each flap region is integrally connected to the paint shield region along a score or fold line. The flap regions essentially comprise at least two retainer flap regions and at least one receptacle-retaining flap region. The receptacle-retaining flap region comprises receptacle retainer means. The rim cover is designed for seated placement upon the rim of the paint container. The paint-deflecting surface is designed for deflecting paint away from the rim. The container accessory further comprises anti-shift means, which function to retaining the paint shield region in superior adjacency to the rim of the paint container.

It is noted that conventional paint containers typically comprise two laterally opposed container knobs extending from the exterior container surface. Bearing these features in mind, the anti-shift means may be essentially defined by comprising two laterally opposed knob-engaging flap regions, the knob-engaging flap regions each comprising a knob-receiving aperture sized and shaped to receive one respective container knob. When the rim cover is seated upon the rim, the knob-receiving apertures receive the container knobs and the knob-engaging flap regions retain the paint shield region in superior adjacency to the rim. It is further noted that conventional paint containers typically comprise a handle, the handle comprising opposite handle ends and a hand grip portion, the hand grip portion being intermediate the handle ends. Bearing these features in mind, the container knobs each comprising handle end-receiving means, which function to receive the handle ends. To be effective, the knob-engaging flap regions each comprise grip portion-receiving means, which enable a user to removably install the rim cover on the paint container.

The paint brush or implement receptacle essentially comprises an exterior receptacle surface and a receptacle mouth, the exterior receptacle surface being selectively retainable by the receptacle retainer means, which receptacle retainer means function to retain the implement receptacle in adjacency to the paint container. The receptacle mouth comprises closure means for selectively enclosing the implement receptacle. It is further noted that the paint access aperture of typical conventional paint containers are circular. Likewise, the container access aperture is substantially circular. The circular container access aperture, however, has a diameter less than the dianeter of the circular paint access aperture. The paint shield region thus functions to prevent paint from contacting the inner container rim.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of my patent drawings, as follows.

DETAILED DESCRIPTION OF THE PREFERRED EMBODIMENT

Figure 1:
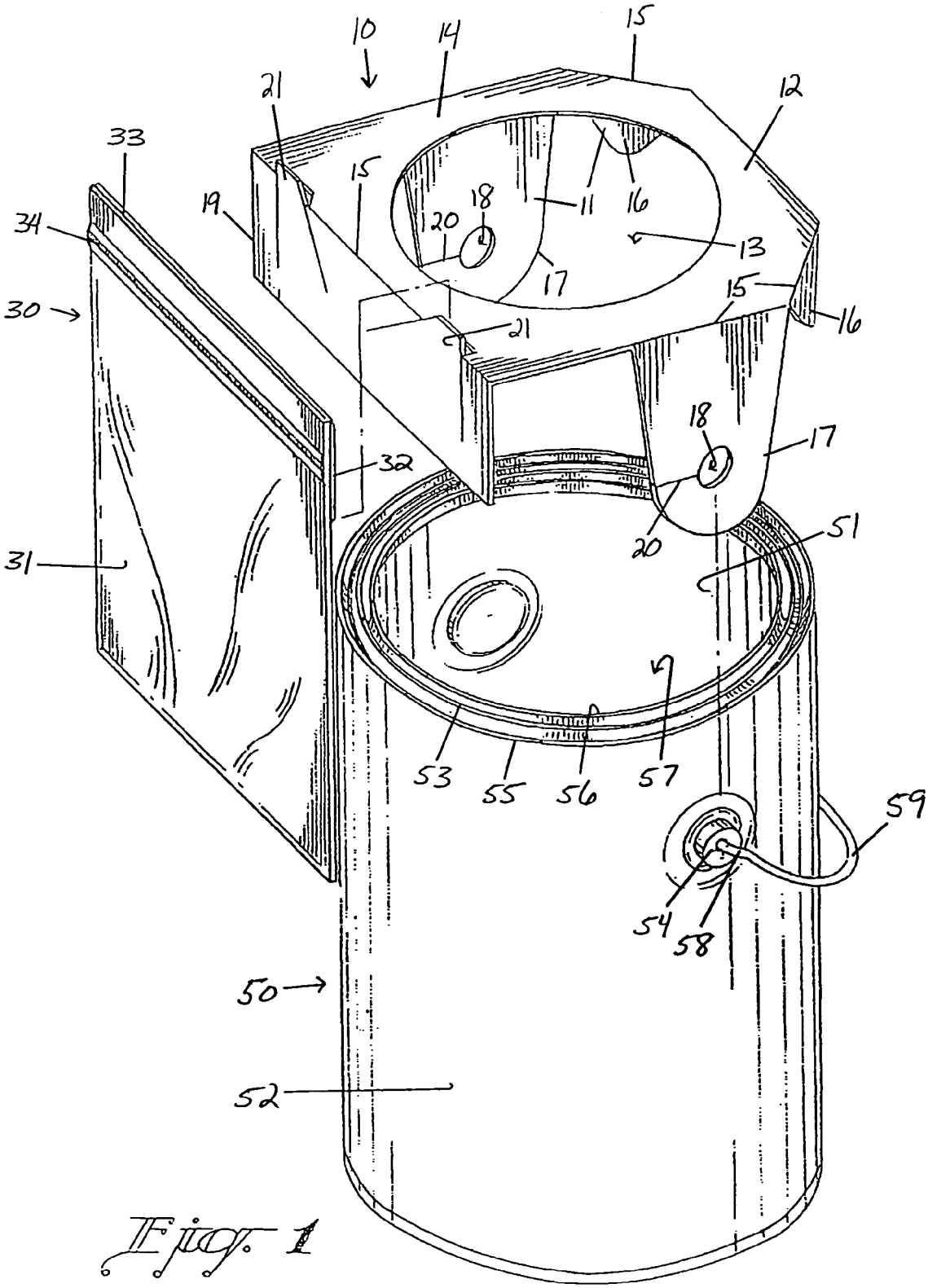
FIG. 1 is an exploded perspective view of a conventional paint container, rim cover, and paint brush receptacle.
Figure 2:
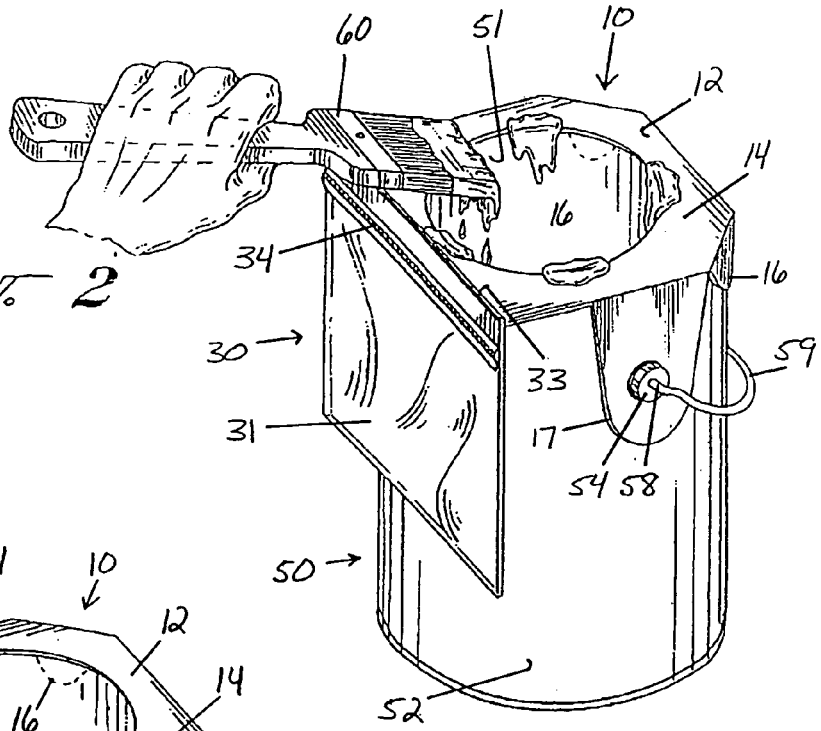
FIG. 2 is a perspective view of the conventional paint container, rim cover, and paint brush receptacle of FIG. 1 in an assembled state showing paint being directed away from the rim of the conventional paint container.
Figure 3:
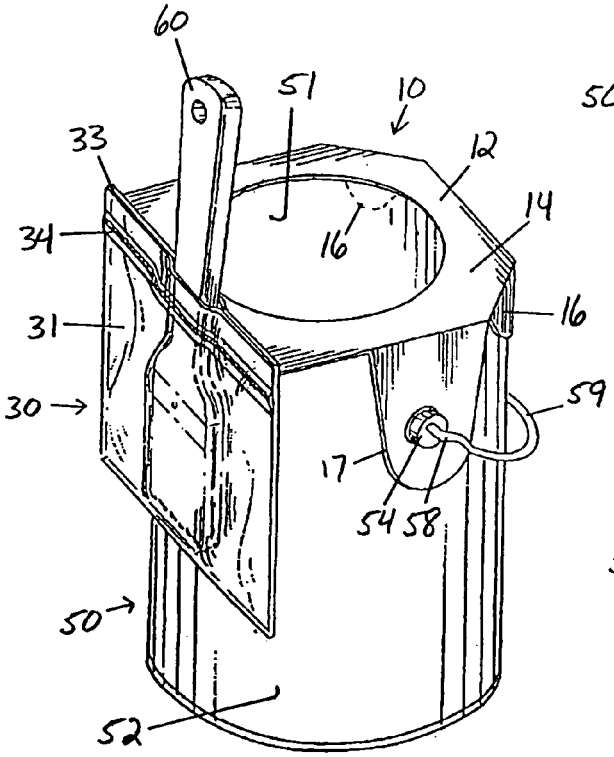
FIG. 3 is a perspective view of the conventional paint container, rim cover, and paint brush receptacle of FIG. 1 in an assembled state showing a portion of a paint brush being received and protected in the paint brush receptacle.
Figure 4:
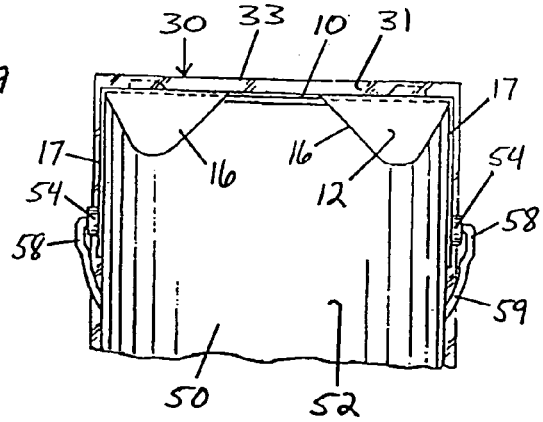
FIG. 4 is a fragmentary lateral view of a conventional paint container with installed rim showing two retainer flap regions.

Referring now to the drawings, the preferred embodiment of the present invention concerns a container accessory for use in combination with a conventional paint container 50 as generally illustrated in FIGS. 1–5, inclusive. It is noted that conventional paint containers typically and essentially comprise an interior container surface 51 as illustrated in FIGS. 1–3, and 5; an exterior container surface 52 as illustrated in FIGS. 1–5; a rim 53 intermediate interior container surface 51 and exterior container surface 52 as illustrated in FIG. 1; and two laterally opposed container knobs 54 extending from exterior container surface 52, one of which is illustrated in FIGS. 1–3, and 5, and two of which are illustrated in FIG. 4. Interior container surface 51 is designed for retaining a given paint volume (not illustrated). It is noted that rim 53 typically and thus preferably comprises an outer rim perimeter 55 and an inner rim perimeter 56 as illustrated in FIG. 1. It will be readily seen from an inspection of FIG. 1 that inner rim perimeter 56 essentially defines a paint access aperture as referenced at 57. In other words, users or painters who utilize conventional paint containers may access the paint volume held by interior container surface 51 through paint access aperture 57.

Typical conventional paint containers such as the one illustrated and referenced by paint container 50 further comprise a handle as may be seen from a general inspection of FIGS. 1–5, inclusive. The handle of paint container 50 essentially comprises opposite handle ends 58, one of which is illustrated in FIGS. 1–3, and 5 and two of which are illustrated in FIG. 4. Further, the handle of paint container 50 comprises a hand grip portion 59 as illustrated in FIGS. 1–5. It will be understood from an inspection of the noted figures that hand grip portion 59 essentially comprises those portions of the handle that are intermediate handle ends 58. It will be further understood from an inspection of the noted figures that container knobs 54 each comprise handle end-receiving means. Typically, the handle end-receiving means may be defined by apertures in hollowed out container knobs 54. Handle ends 58 then terminate in the apertures and may either be fixedly received by container knobs 54 (typically when the terminus of each handle end 58 is curved or bent) or removably received by container knobs 54 (typically when the terminus of each handle end 58 is linear).

It will be seen from a further inspection of FIG. 1 that an annular groove is typically located intermediate outer rim perimeter 55 and inner rim perimeter 56. As earlier described, the annular groove is adapted to receive a cover or lid flange, the flange being pried out from frictional engagement with the walls of the groove when the paint container is opened. As has been noted in U.S. Pat. No. 2,591,482, during the painting operation, the user will often manually wipe the paint brush 60 or painting implement on the rim after dipping the same into paint container 50 in an effort to remove excess or unneeded paint from the painting implement as has been generally depicted in FIG. 2. Typically, a significant quantity of excess paint is removed and often collects in the annular groove in which the cover or lid flange is supposed to become wedged. The excess paint, if left in the annular groove open to ventilated surroundings will dry according to earlier described processes. This not only wastes paint, but renders it difficult to properly reseat the cover flange in the annular groove to form a tight seal. It is contemplated that manufacturers of paint containers may, in an effort to remedy the described shortcoming, engineer away the annular groove. It is further contemplated, however, that paint containers will more than likely retain some form of a rim structure in order for users to properly access the paint volume. The present invention is designed to not only cover or protect the annular groove, but to cover rim 53 in its entirety. In other words, it is contemplated that the present invention is designed to protect rim 53, whether or not rim 53 comprises an annular groove.

The container accessory preferably comprises in combination a protective rim cover 10 and a paint brush receptacle 30 or implement receptacle as have been generally illustrated in FIGS. 1–5. Rim cover 10 is preferably constructed from low cost, durable, and light-weight material. Excellent results have been obtained when rim cover 30 is constructed from 0.5 mm thick vinyl or similar other material, such as polyethylene. Rim cover 10 is preferably formed from a foldable blank and comprises a container-engaging surface 11 as illustrated in FIG. 1; a paint-deflecting surface 12 as illustrated in FIGS. 1–5; a container access aperture 13 as illustrated in FIG. 1; a substantially horizontal paint shield region 14 adjacent container access aperture 13 as illustrated in FIGS. 1–3, and 5; and at least three, but preferably five substantially vertical flap regions.

Each flap region in integrally connected to paint shield region 14 along a score line or fold line 15 as has been generally illustrated in FIG. 1. The flap regions preferably comprise at least one retainer flap region 16, two of which are referenced in FIGS. 1–4, and one of which is referenced in FIG. 5. It is contemplated that rim cover 10 could conceivably function with a single centrally-located retainer flap region 16 (not illustrated) as opposed to two laterally spaced retainer flap regions (as illustrated). However, excellent results have been obtained utilizing two laterally spaced retainer flap regions 16 and thus the preferred embodiment of rim cover 10 comprises two laterally spaced retainer flap regions 16. These points are addressed in more detail below.

Figure 5:
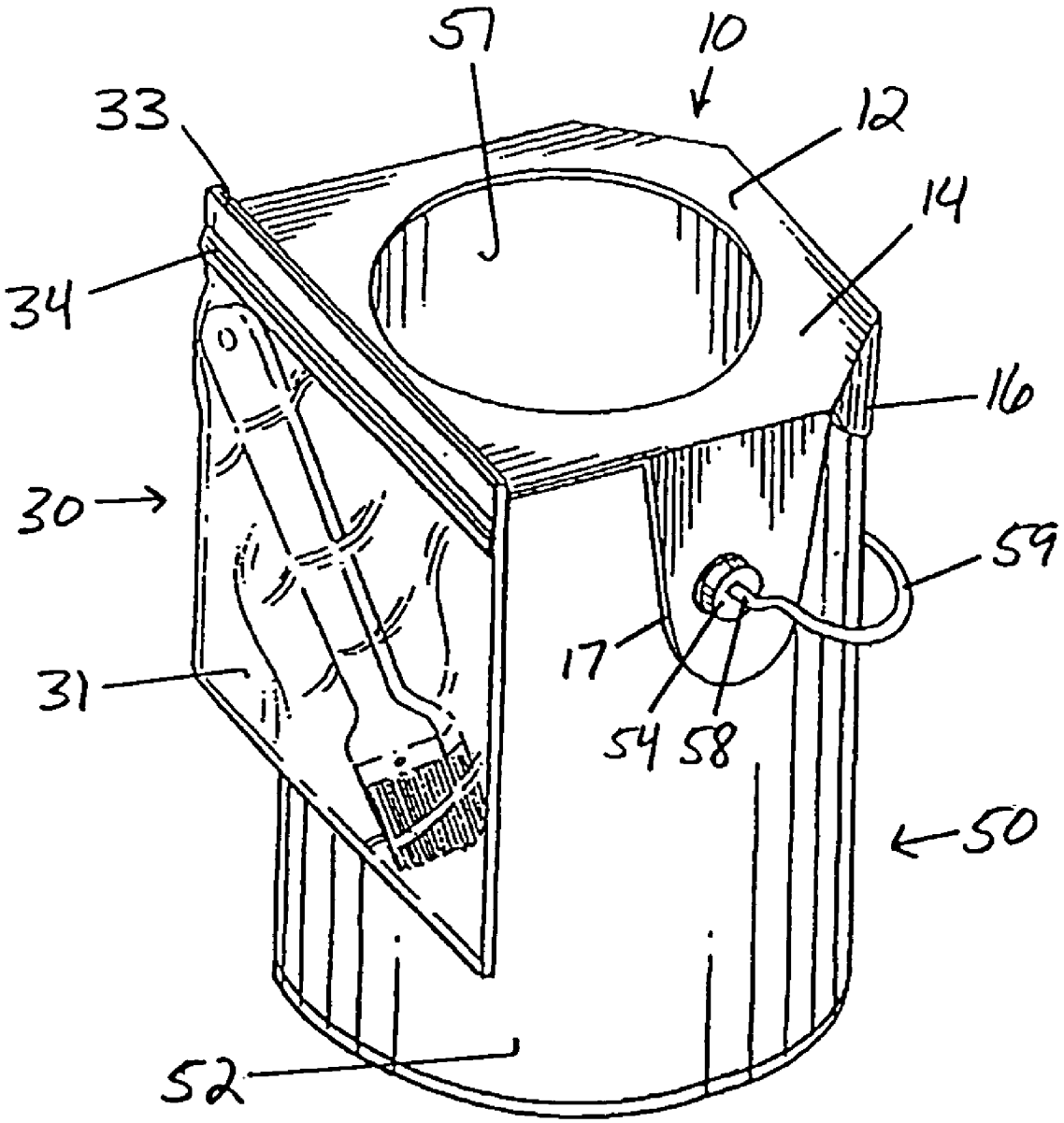
FIG. 5 is a perspective view of the conventional paint container, rim cover, and paint brush receptacle of FIG. 1 in an assembled state showing an entire paint brush being received and protected in the paint brush receptacle.

Rim cover 10 further preferably comprises two laterally opposed knob-engaging flap regions 17, two of which are specifically referenced in FIGS. 1 and 4, and one of which is specifically references in FIGS. 2, 3, and 5. Knob-engaging flap regions 17 each preferably comprise a knob-receiving aperture 18 as specifically referenced in FIG. 1. Knob-receiving apertures 18 are each preferably being sized and shaped to snugly receive one container knob 54 as may be seen from a general comparison of FIG. 1 with FIGS. 2, 3, and 5. In other words, each knob-receiving aperture 18 may snugly encircle or receive a container knob 54.

By so encircling or receiving container knobs 54, knob-receiving apertures 18 and knob-engaging flap regions 17 cooperate to retain paint shield region 14 in superior adjacency to rim 53. That is, paint shield region 14 is effectively prevented from shifting or translating in a vertical direction since the tensile properties of knob-engaging flap regions (preferably constructed from vinyl or polyethylene) tend to be rather inelastic. Further, it will be understood that knob-engaging flap regions 17 also prevent paint shield region 14 from shifting or translating horizontally in a direction parallel to an axis or imaginary line extending through knob-receiving apertures 18. By so preventing or restricting vertical or horizontal movement, knob-receiving apertures 18 and knob-engaging flap regions 17 cooperate to retain paint shield region 14 in superior adjacency to rim 53.

In the event paint container 50 comprises a handle, knob-engaging flap regions 17 each preferably comprise grip portion-receiving means, which enable a user to install rim cover 10 on paint container 50. The grip portion-receiving means may preferably be defined by receiving slots 20 as referenced in FIG. 1. Slots 20 thus enable to user to manually place or encircle knob-receiving apertures 18 around container knobs 54. The handle or hand grip portion 59 may translate through the knob-engaging flap region 17 via slots 20 and thus knob-engaging flap regions may be drawn in close proximity to exterior container surface 52 such that knob-receiving apertures 18 are snugly received on container knobs 54 also in snug adjacency to exterior container surface 52.

Rim cover 10 further preferably comprises at least one receptacle-retaining flap region 19 as illustrated in FIG. 1. It is contemplated that more than one receptacle-retaining flap region 19 may function to effectively retain more than one paint brush receptacle 30 in adjacency to paint container 50. Excellent results have been obtained, however, utilizing a single receptacle-retaining flap region 19, in which the fold line 15 associated therewith extends the entire width or length of paint shield region 14 as generally illustrated in FIG. 1. Receptacle-retaining flap region 19 preferably further comprises receptacle retainer means for retaining paint brush receptacle 30 in adjacency to paint container 50.

The receptacle retainer means may be defined by comprising at least one, but preferably two laterally spaced, upwardly extending receptacle retainer tabs 21 as illustrated in FIG. 1. Receptacle retainer tabs 21 are formed by providing slits in rim cover adjacent the fold line 15 associated with receptacle-retaining flap region 19 such that when receptacle retaining flap region 19 is distended in a vertical orientation, receptacle retainer tabs 21 extend in an upwardly direction substantially as illustrated in FIG. 1. The preferred vinyl or polyethylene construction material provides sufficient load-bearing strength to maintain receptacle retainer tabs 21 in a substantially vertical orientation when burdened with a load, namely, paint brush receptacle 30 and its contents.

Paint brush receptacle 30 or the painting implement receptacle is preferably constructed from a low cost, flexible, lightweight receptacle material, which material is impervious to air. Excellent results have been obtained utilizing resealable plastic storage bags such as common household sandwich bags and the like. Materials of this type may be more readily discarded after use than are the rigid paint brush receptacles as taught by the '943 patent, the '217 patent, or the '666 patent. Paint brush receptacle 30 preferably comprises an exterior receptacle surface 31 as referenced in FIGS. 1–5; a tab-engaging fold 32 as referenced in FIG. 1; and a receptacle mouth 33 as referenced in FIGS. 1–5. Tab-engaging fold 32 is formed adjacent exterior receptacle surface 31 and receptacle mouth 33 such that tab-engaging fold 32 may be easily received on receptacle retainer tabs 21. It will thus be seen that receptacle retainer tabs 21 thus function to retain paint brush receptacle 30 in adjacency to paint container 50.

Receptacle mouth 33 preferably comprises closure means 34 for selectively enclosing paint brush receptacle 30 so that air is prevented or restricted from circulating within paint brush receptacle 30. Closure means 34 are referenced in FIGS. 1–3, and 5. The closure means 34 may be defined by comprising resealable slide lock or resealable zipper style means for resealing the preferred plastic bags. Excellent results have been obtained using ZIPLOC brand storage bags or similar other type storage bags when closure means 34 are desired. It will be seen from an inspection of FIG. 3 and 5 that the author contemplates a paint brush 60 or other painting implement may either be placed into paint brush receptacle 30 either in its entirety (as illustrated in FIG. 5) or in part (as illustrated in FIG. 3). In other words, paint brush receptacle functions to either encase a portion of a painting implement and a portion of a painting implement per the needs of the end user. The paint brush receptacle is thus preferably sized and shaped to receive the entire structure of a paint brush. As illustrated, paint brush receptacle 30 is formed into a substantially rectangular configuration. This configuration operates to keep manufacturing costs at a minimum. It is contemplated that the rectangular shaped paint brush receptacle 30 as shown in the drawings is representative of the preferred embodiment and is not intended as a limitation. In any event, it will be understood from a consideration of the noted figures that ambient air surrounding a painting implement received in paint brush receptacle 30 is either prevented or restricted from circulating about paint brush 60 thus retarding the evaporative process by which paint dries and protecting paint brush 60 or other painting implement. It will be recalled that paint brushes or other painting implements typically retain some amount of excess paint in the paint stroke portion of paint brush 60 or painting implement. It is the described tendency for excess paint to be retained by painting implements that has, in part, given rise to the present invention.

It should be noted from a consideration of the figures that when rim cover 10 is seated atop rim 53 of paint container 50 that the fold lines 15 associated with all of the flap regions are oriented such that they are substantially tangent to outer rim perimeter 55. In this manner, the fold lines 15 and the flap regions cooperate to prevent rim cover 10 from shifting or translating in a horizontal direction atop rim 53. It will be recalled that in the preferred embodiment, it is contemplated that rim cover 10 preferably comprises at least two retainer flap regions 16 and a single receptacle-retaining flap region 19. In this regard, it is contemplated that two laterally spaced receptacle retainer tabs 21 are preferable to one receptacle retainer tab 21 in that two receptacle retainer tabs provide a more stable upright dual structure upon which to position tab-engaging fold 32 and further spatially orientate paint brush receptacle 30 such that receptacle mouth 33 lies in a substantially horizontal plane parallel to paint shield region 14.

Given these considerations, it is preferred that the manufacturer equip the present invention with two spaced retainer tabs 16. Three flap regions with associated tangential fold lines 15 thus more effectively prevent paint shield region 14 from shifting or otherwise translating horizontally atop rim 53 of container 50. It should perhaps be noted that given at least three flap regions with spaced fold lines 15 such as is contemplated by this writing, knob-engaging flap regions would not necessarily be required in the construction to effectively prevent paint shield region from shifting in a substantially horizontal direction. However, if the end user or manufacturer is desirous of preventing rim cover 10 or paint shield region 14 from shifting or translating vertically, it is contemplated that knob-engaging flap regions 17 equipped with knob-engaging apertures 18 are necessary. When equipped with knob-engaging flap regions 17, the present invention, via all fold lines 15 and flap regions, functions to prevent both vertical shift as well as horizontal shift and thus function to retain paint shield region 14 in superior adjacency to rim 53.

It is further contemplated that paint access aperture 57 and container access aperture 13 are substantially circular in configuration, and thus each aperture 57 and 13 comprise a measurable diameter. Preferably, the diameter of container access aperture 13 is of lesser magnitude than the diameter of paint access aperture 57. In other words, container access aperture 13 is generally smaller than paint access aperture 57 so that paint shield region 14 more effectively prevents paint from contacting either inner container rim 56 or rim 53 in general.

It will be seen that the present invention further provides a low cost, maintenance-efficient paint container accessory, which container accessory enables the user to simultaneously protect the annular groove or rim of a conventional paint container as well as the paint brush or implement used in connection therewith. In this regard, it will be seen that the present invention provides a container accessory for use in combination with a paint container, which container accessory embodies improvements over the state of the art. Further, it will be seen that the present invention provides a container accessory constructed from low cost materials, formed into readily disposable single use items.

More specifically, it will be seen that the present invention provides a paint container accessory wherein the container accessory comprises a uniquely configured rim cover for seated placement upon the rim of a paint container, the exposed or paint-deflecting surface of which deflects paint away from the paint container rim. Further, it will be seen that the present invention provides a container accessory further comprising a paint brush receptacle, which receptacle functions to not only retain a user's paint brush in adjacency to the paint container, but also functions to retard the evaporation of liquid components from excess paint held by the paint brush. In this last regard, it will be seen that the present invention provides a paint brush receptacle, the mouth of which comprises closure means, the closure means for selectively enclosing the paint brush receptacle for retarding the evaporative processes.

While the above description contains much specificity, this specificity should not be construed as limitations on the scope of the invention, but rather as an exemplification of the invention. For example, it is contemplated that the receptacle retainer means need not be defined by upwardly extending receptacle retainer tabs 21. The receptacle retainer means may, for example, be defined by adhesive means for retaining paint brush receptacle in adjacency to paint container 50. If adhesive means were applied to paint-deflecting surface 12 of receptacle-retaining flap region 19 and exterior receptacle surface 31 were adhesively attached to receptacle-retaining flap region 19 adjacent receptacle mouth 33, it is believed that the described structural arrangement is within the spirit of the present invention and thus the present invention is effectively practiced thereby.

Accordingly, although the invention has been described by reference to a preferred embodiment, it is not intended that the novel assembly be limited thereby, but that modifications thereof are intended to be included as falling within the broad scope and spirit of the foregoing disclosure, the following claims and the appended drawings.

I claim:

1. A paint container assembly for protecting a paint container rim and a paint brush, the paint container assembly comprising, in combination:

a paint container, the paint container comprising an interior container surface, an exterior container surface, a rim intermediate the interior container surface and the exterior container surface, and two laterally opposed container knobs extending from the exterior container surface, the interior container surface retaining a paint volume, the rim comprising an outer rim perimeter and an inner rim perimeter, the inner rim perimeter defining a paint access aperture;

a rim cover, the rim cover comprising a container-engaging surface, a paint-deflecting surface, a container access aperture extending from the paint-deflecting surface to the container-engaging surface, a substantially horizontal paint shield region adjacent the container access aperture, and five substantially vertical flap regions, each flap region being integrally connected to the paint shield region along a fold line, the flap regions comprising two retainer flap regions, two laterally opposed knob-engaging flap regions, and one receptacle-retaining flap region, the knob-engaging flap regions each comprising a knob-receiving aperture, each knob-receiving aperture being sized and shaped to receive one container knob, the receptacle-retaining flap region comprising at least one upwardly extending receptacle retainer tab, the rim cover being seated upon the rim, the knob-receiving apertures receiving the container knobs, the flap regions for retaining the paint shield region in superior adjacency to the rim, the paint-deflecting surface for deflecting paint away from the rim; and a paint brush receptacle, the paint brush receptacle being constructed from a flexible material, the flexible material being impervious to air, the paint brush receptacle comprising an exterior receptacle surface, a tab-engaging fold, and a receptacle mouth, the tab-engaging fold being adjacent the exterior receptacle surface and the receptacle mouth, the tab-engaging fold being received on the receptacle retainer tab, the receptacle retainer tab thus retaining the paint brush receptacle in adjacency to the paint container.

2. The paint container assembly of claim 1 wherein the receptacle mouth comprises closure means, the closure means for selectively enclosing the paint brush receptacle.

3. The paint container assembly of claim 1 wherein the paint container comprises a handle, the handle comprising opposite handle ends and a hand grip portion, the hand grip portion being intermediate the handle ends, the container knobs each comprising handle end-receiving means, the handle end-receiving means receiving the handle ends, the knob-engaging flap regions each comprising grip portion-receiving slots, the grip portion-receiving slots for enabling a user to install the rim cover on the paint container.

4. The paint container assembly of claim 1 wherein the rim cover is formed from a foldable blank.

5. The paint container assembly of claim 1 wherein the fold lines are substantially tangent to the outer rim perimeter, the fold lines and flap regions thus preventing the rim cover from shifting horizontally atop the rim.

6. The paint container assembly of claim 1 wherein the paint access aperture and the container access aperture are substantially circular, the container access aperture and the paint access aperture each comprising a measurable diameter, the container access aperture diameter being lesser in magnitude than the paint access aperture diameter, the paint shield region thus preventing paint from contacting the inner container rim.

7. A container accessory for use in combination with a paint container, the paint container comprising an interior container surface, an exterior container surface, a rim intermediate the interior container surface and the exterior container surface, and two laterally opposed container knobs extending from the exterior container surface, the interior container surface for retaining a paint volume, the rim comprising an outer rim perimeter and an inner rim perimeter, the inner rim perimeter defining a paint access aperture, the container accessory comprising, in combination:

a rim cover, the rim cover comprising a container-engaging surface, a paint-deflecting surface, a container access aperture extending from the paint deflecting surface to the container-engaging surface, a substantially horizontal paint shield region adjacent the container access aperture, and at least four substantially vertical flap regions, each flap region being integrally connected to the paint shield region along a fold line, the flap regions comprising at least one retainer flap region, two laterally opposed knob-engaging flap regions, and at least one receptacle-retaining flap region, the knob-engaging flap regions each comprising a knob-receiving aperture, the knob-receiving apertures each being sized and shaped to receive one container knob, the receptacle-retaining flap region comprising receptacle retainer means, the rim cover for seated placement upon the rim, the knob-receiving apertures for receiving the container knobs, the flap regions for retaining the paint shield region in superior adjacency to the rim, the paint-deflecting surface for deflecting paint away from the rim; and a painting implement receptacle, the painting implement receptacle being constructed from a receptacle material, the receptacle material being impervious to air, the paint brush receptacle comprising an exterior receptacle surface and a receptacle mouth, the exterior receptacle surface being selectively retainable by the receptacle retainer means, the receptacle retainer means for retaining the painting implement receptacle in adjacency to the paint container.

8. The container accessory of claim 7 wherein the receptacle mouth comprises closure means, the closure means for selectively enclosing the painting implement receptacle.

9. The container accessory of claim 7 wherein the container accessory is for use in combination with the paint container, the paint container comprising a handle, the handle comprising opposite handle ends and a hand grip portion, the hand grip portion being intermediate the handle ends, the container knobs each comprising handle end-receiving means, the handle end-receiving means fixedly receiving the handle ends, the knob-engaging flap regions each comprising grip portion-receiving means, the grip portion-receiving means for enabling a user to install the rim cover on the paint container.

10. The container accessory of claim 7 wherein the rim cover is formed from a foldable blank.

11. The container accessory of claim 7 wherein the fold lines are substantially tangent to the outer rim perimeter, the fold lines and flap regions for preventing the rim cover from shifting horizontally atop the rim.

12. The container accessory of claim 7 wherein the paint access aperture and the container access aperture are substantially circular, the container access aperture and the paint access aperture each comprising a measurable diameter, the container access aperture diameter being lesser in magnitude than the paint access aperture diameter, the paint shield region for preventing paint from contacting the inner container rim.

13. A container accessory for use in combination with a paint container, the paint container comprising an interior container surface, an exterior container surface, and a circular rim intermediate the interior container surface and the exterior container surface, the interior container surface for retaining a paint volume, the rim comprising an outer rim perimeter and an inner rim perimeter, the inner rim perimeter defining a paint access aperture, the container accessory comprising:

a rim cover, the rim cover comprising a container-engaging surface sized and shaped to overlie the circular rim, a paint-deflecting surface, a container access aperture extending from the paint-deflecting surface to the container-engaging surface, a substantially horizontal paint shield region adjacent the container access aperture being sized and circularly shaped to overlie and shield the circular rim in its entirety, and at least three substantially vertical flap regions, each flap region being connected to the paint shield region along a fold line, the flap regions comprising at least two retainer flap regions and at least one receptacle-retaining flap region, the receptacle-retaining flap region comprising receptacle retainer means for engagement with paint container handle retaining knobs spaced below a paint container rim, the rim cover for seated placement upon the rim, the paint-deflecting surface for deflecting paint away from the rim.

14. The container accessory of claim 13 wherein the container accessory comprises anti-shift means, the anti-shift means for retaining the paint shield region in superior adjacency to the rim.

15. The container accessory of claim 14 wherein the container accessory is for use in combination with the paint container, the paint container comprising two laterally opposed container knobs extending from the exterior container surface, the anti-shift means being defined by two laterally opposed knob-engaging flap regions, the knob-engaging flap regions each comprising a knob-receiving aperture, the knob-receiving apertures each being sized and shaped to receive one container knob, the rim cover for seated placement upon the rim, the knob-receiving apertures for receiving the container knobs, the knob-engaging flap regions for retaining the paint shield region in superior adjacency to the rim.

16. The container accessory of claim 15 wherein the container accessory is for use in combination with the paint Container, the paint container comprising a handle, the handle comprising opposite handle ends and a hand grip portion, the hand grip portion being intermediate the handle ends, the container knobs each comprising handle end-receiving means, the handle end-receiving means receiving the handle ends, the knob-engaging flap regions each comprising grip portion-receiving means, the grip portion-receiving means enabling a user to removably install the rim cover on the paint container.

17. The container accessory of claim 13 wherein the fold lines are substantially tangent to the outer rim perimeter, the fold lines and flap regions for preventing the rim cover from shifting horizontally atop the rim.

18. The container accessory of claim 13 wherein the paint access aperture and the container access aperture are substantially circular, the container access aperture and the paint access aperture each comprising a measurable diameter, the container access aperture diameter being lesser in magnitude than the paint access aperture diameter, the paint shield region for preventing paint from contacting the inner container rim.

19. A container accessory for use in combination with a paint container, the paint container comprising an interior container surface, an exterior container surface, and a circular rim intermediate the interior container surface and the exterior container surface, the interior container surface for retaining a paint volume, the rim comprising an outer rim perimeter and an inner rim perimeter, the inner rim perimeter defining a paint access aperture, the container accessory comprising:

a rim cover, the rim cover comprising a container-engaging surface sized and shaped to overlie the circular rim, a paint-deflecting surface, a container access aperture extending from the paint-deflecting surface to the container-engaging surface, a substantially horizontal paint shield region adjacent the container access aperture being sized and circularly shaped to overlie and shield the circular rim in its entirety, and at least three substantially vertical flap regions, each flap region being connected to the paint shield region along a fold line, the flap regions comprising at least two retainer flap regions and at least one receptacle-retaining flap region, the receptacle-retaining flap region comprising receptacle retainer means, the rim cover for seated placement upon the rim, the paint-deflecting surface for deflecting paint away from the rim, and wherein the paint access aperture and the container access aperture are substantially circular, the container access aperture and the paint access aperture each comprising a measurable diameter, the container access aperture diameter being lesser in magnitude than the paint access aperture diameter, the paint shield region for preventing paint from contacting the inner container rim.

20. A container accessory for use in combination with a paint container, the paint container comprising an interior container surface, an exterior container surface, and a circular rim intermediate the interior container surface and the exterior container surface, the interior container surface for retaining a paint volume, the rim comprising an outer rim perimeter and an inner rim perimeter, the inner rim perimeter defining a paint access aperture, the container accessory comprising:

a rim cover, the rim cover comprising a container-engaging surface sized and shaped to overlie the circular rim, a paint-deflecting surface, a container access aperture extending from the paint-deflecting surface to the container-engaging surface, a substantially horizontal paint shield region adjacent the container access aperture being sized and circularly shaped to overlie and shield the circular rim in its entirety, and at least three substantially vertical flap regions, each flap region being connected to the paint shield region along a fold line, the flap regions comprising at least two retainer flap regions and at least one receptacle-retaining flap region, the receptacle-retaining flap region comprising receptacle retainer means, the rim cover for seated placement upon the rim, the paint-deflecting surface for deflecting paint away from the rim, and wherein the container accessory is for use in combination with the paint container, the paint container comprising two laterally opposed container knobs extending from the exterior container surface, the knob-engaging flap regions each comprising a knob-receiving aperture, the knob-receiving apertures each being sized and shaped to receive one container knob, the rim cover for seated placement upon the rim, the knob-receiving apertures for receiving the container knobs, the knob-engaging flap regions for retaining the paint shield region in superior adjacency to the rim.

* * * * *